US008783945B2

(12) United States Patent
Vonsild et al.

(10) Patent No.: US 8,783,945 B2
(45) Date of Patent: Jul. 22, 2014

(54) SUPERHEAT SENSOR

(75) Inventors: Asbjoern Leth Vonsild, Vejle (DK); Claus Thybo, Soenderborg (DK); Leo Bram, Augustenborg (DK); Jakob Spangberg, Soenderborg (DK)

(73) Assignee: Danfoss A/S, Nordborg (DK)

( * ) Notice: Subject to any disclaimer, the term of this patent is extended or adjusted under 35 U.S.C. 154(b) by 467 days.

(21) Appl. No.: 13/059,506

(22) PCT Filed: Aug. 18, 2009

(86) PCT No.: PCT/DK2009/000182

§ 371 (c)(1),
(2), (4) Date: Apr. 29, 2011

(87) PCT Pub. No.: WO2010/020249

PCT Pub. Date: Feb. 25, 2010

(65) Prior Publication Data

US 2011/0192224 A1 Aug. 11, 2011

(30) Foreign Application Priority Data

Aug. 19, 2008 (DK) ..... 2008 01123

(51) Int. Cl.
*G01N 25/08* (2006.01)
*G01N 25/40* (2006.01)

(52) U.S. Cl.
USPC ..... 374/16; 374/141; 374/28; 374/208; 374/100; 374/203; 374/198; 374/143; 374/6; 374/163

(58) Field of Classification Search
USPC ..... 374/16, 28, 33, 39, 4, 100, 141, 148, 374/147, 208, 198–203, 204, 206, 29, 163, 374/6, 143, 45
See application file for complete search history.

(56) References Cited

U.S. PATENT DOCUMENTS 2,291,898 A * 8/1942 Holmes ..... 62/212
4,333,317 A * 6/1982 Sawyer ..... 62/212

(Continued)

FOREIGN PATENT DOCUMENTS

GB 2302725 A 1/1997
JP 57-35632 U 2/1982

(Continued)

OTHER PUBLICATIONS

International search report for PCT/DK2009/000182 dated Nov. 6, 2009.

*Primary Examiner* — Gail Verbitsky
(74) *Attorney, Agent, or Firm* — McCormick, Paulding & Huber LLP

(57) ABSTRACT

A superheat sensor (1) for sensing superheat of a fluid flowing in a flow channel (3) is disclosed. The sensor (1) comprises a flexible wall defining an interface between an inner cavity (5) having a charge fluid (6) arranged therein and the flow channel (3). The flexible wall is arranged in the flow channel (3) in thermal contact with the fluid flowing therein, and the flexible wall is adapted to conduct heat between the flow channel (3) and the inner cavity (5). Thereby the temperature of the charge fluid (6) adapts to the temperature of the fluid flowing in the flow channel (3), and the pressure in the inner cavity (5) is determined by this temperature. A first wall part (7, 14) and a second wall part (9, 16) are arranged at a variable distance from each other, said distance being defined by a differential pressure between the pressure of the charge fluid (6) and the pressure of the fluid flowing in the flow channel (3), i.e. depending on the pressure and the temperature of the fluid flowing in the flow channel (3), and thereby the superheat of the fluid. A distance sensor, e.g. comprising a permanent magnet (8) and a Hall sensor (10), measures the distance between the wall parts, and the superheat is calculated from the measured distance. The sensor (1) is suitable for use in a refrigeration system. The sensor (1) is mechanically simple and capable of determining the superheat by measuring only one parameter.

10 Claims, 2 Drawing Sheets

(56) References Cited

U.S. PATENT DOCUMENTS

| | | | | | |
|---|---|---|---|---|---|
| 4,484,452 | A | * | 11/1984 | Houser, Jr. | 62/174 |
| 4,545,212 | A | | 10/1985 | Noda | |
| 4,606,198 | A | * | 8/1986 | Latshaw et al. | 62/205 |
| 4,660,387 | A | | 4/1987 | Usami | |
| 5,070,706 | A | * | 12/1991 | Waters et al. | 62/129 |
| 5,170,638 | A | * | 12/1992 | Koenig et al. | 62/204 |
| 5,243,829 | A | * | 9/1993 | Bessler | 62/126 |
| 5,285,648 | A | * | 2/1994 | Bessler | 62/129 |
| 5,301,514 | A | * | 4/1994 | Bessler | 62/126 |
| 2011/0061412 | A1 | * | 3/2011 | Bayram | 62/222 |
| 2011/0222576 | A1 | * | 9/2011 | Vonsild et al. | 374/1 |

FOREIGN PATENT DOCUMENTS

| | | | |
|---|---|---|---|
| JP | 62-5538 | U | 1/1987 |
| WO | 2007/053801 | A2 | 10/2007 |

* cited by examiner

SUPERHEAT SENSOR

CROSS REFERENCE TO RELATED APPLICATIONS

This application is entitled to the benefit of and incorporates by reference essential subject matter disclosed in International Patent Application No. PCT/DK2009/000182 filed on Aug. 18, 2009 and Danish Patent Application No. PA 2008 01123 filed on Aug. 19, 2008.

FIELD OF THE INVENTION

The present invention relates to a sensor for sensing superheat of a fluid flowing in a flow channel, in particular superheat of a refrigerant flowing in a refrigerant path of a refrigeration system.

BACKGROUND OF THE INVENTION

In refrigeration systems, such as cooling systems or air condition systems, the superheat of the refrigerant flowing in the system is often used for controlling the flow of refrigerant through the system. More particularly, a superheat value is often used as a control parameter for controlling an expansion valve arranged in the refrigerant path. Accordingly, it is often desirable to be able to obtain a superheat value for the refrigerant.

U.S. Pat. No. 4,660,387 discloses a control device having a detector for detecting the degree of superheating or supercooling of refrigerating or air-conditioning units. The detector includes a pressure responsive chamber for guiding the pressure of a coolant and a diaphragm disposed therein. The diaphragm is connected with a temperature-responsive cylinder for sensing the temperature of the coolant and a connecting rod. The connecting rod moves corresponding to the pressure and temperature of the coolant, and the position thereof is sensed by a position sensor means.

U.S. Pat. No. 5,070,706 discloses a superheat sensor for sensing the superheat of a fluid flowing through a fluid channel. The superheat sensor includes an aperture within the fluid channel and a sensor body engaging the aperture with a fluid tight seal between the body and the aperture. The sensor body has a sensor body channel in fluid communication with fluid flowing within the fluid channel. A pressure sensor contained within the sensor body has a pressure responsive element in fluid communication with the fluid flowing through the fluid channel for producing an electrical signal representative of pressure of fluid flowing in the fluid channel. A temperature sensor connected to the sensor body has at least one surface in fluid communication with the fluid flowing through the fluid channel for producing an electrical signal representation of temperature of fluid flowing in the fluid channel. A superheat calculator produces a superheat signal in response to the electrical signals representative of pressure and temperature.

U.S. Pat. No. 4,333,317 discloses an automatic control for a refrigeration system for regulating superheat of refrigerant in its gaseous phase existing in the system. The control includes a sensor arranged in thermal control with the system suction line that is divided by a diaphragm into two chambers. One chamber is exposed to suction gas and the other chamber contains a fluid that is essentially the same as the system refrigerant. Mounted on the diaphragm is a four leg strain gage bridge sensor that produces an electrical signal in response to the pressure differential between the chambers.

SUMMARY OF THE INVENTION

It is an object of the invention to provide a superheat sensor in which the temperature of the fluid is reflected in the obtained superheat value in a more accurate manner than it is the case in prior art superheat sensors.

It is a further object of the invention to provide a superheat sensor in which the number of required components is reduced as compared to prior art superheat sensors.

It is an even further object of the invention to provide a superheat sensor which is mechanically simpler than prior art superheat sensors.

According to the invention the above and other objects are obtained by providing a superheat sensor for sensing superheat of a fluid flowing in a flow channel, the sensor comprising:

- a flexible wall defining an interface between an inner cavity having a charge fluid arranged therein and the flow channel, the flexible wall being arranged in the flow channel in thermal contact with the fluid flowing therein, and the flexible wall being adapted to conduct heat between the flow channel and the inner cavity,
- a first wall part and a second wall part arranged at a variable distance from each other, said distance being defined by a differential pressure between the pressure of the charge fluid and the pressure of the fluid flowing in the flow channel,
- a distance sensor for measuring the distance between the first wall part and the second wall part, and
- means for calculating the superheat of the fluid flowing in the flow channel, based on the measured distance.

Superheat is normally defined as the difference between the actual temperature of a fluid and the dewpoint of the fluid. Accordingly, the superheat depends on the temperature as well as the pressure of the fluid. As mentioned above, the superheat of a refrigerant is often used as a control parameter for controlling operation of a refrigeration system having the refrigerant flowing in its refrigerant path. The superheat is suitable for this purpose because it provides a measure for the efficiency of the refrigeration system. If the superheat is high it is an indication that too much gaseous refrigerant leaves the evaporator. Thus, the refrigeration capacity of the evaporator is not utilised to the full extent, and the refrigeration system is therefore operating in an inefficient manner. On the other hand, if the superheat is very low, i.e. close to zero, there is a risk that liquid refrigerant is passed through the evaporator. This is undesirable, since it may cause damage to the compressor.

Accordingly, it is desired to operate the refrigeration system in such a manner that a suitable value of the superheat is maintained, thereby ensuring that the refrigeration capacity of the refrigeration system is utilised to the greatest possible extent, without risking damage to the compressor. To this end it is necessary to obtain the superheat of the fluid.

The flow channel may advantageously form part of a refrigerant path of a refrigeration system, and the fluid may advantageously be a suitable refrigerant.

In the present context the term 'fluid' should be interpreted to cover a liquid, a gas or a mixture of liquid and gas.

The flexible wall defines an interface between an inner cavity and the flow channel. In the present context the term 'inner cavity' should be interpreted to mean a substantially closed volume which is fluidly separated from the flow channel. Thus, the fluid flowing in the flow channel is not allowed to enter the inner cavity. The flexible wall may completely enclose the inner cavity. Alternatively, the flexible wall may only form part of the enclosure of the inner cavity. In this case part of the inner cavity may be enclosed by one or more substantially fixed walls, i.e. walls which are not flexible or movable.

The inner cavity has a charge fluid arranged therein. Since the inner cavity is substantially closed, the amount of charge fluid in the inner cavity is substantially constant. The charge fluid is a fluid with well defined and well known thermostatic properties, and with a well defined and a well known vapour pressure curve. Accordingly, there is a well defined correspondence between the temperature of the charge fluid and the pressure inside the inner cavity.

The flexible wall is arranged in the flow channel in thermal contact with the fluid flowing therein, and the flexible wall is adapted to conduct heat between the flow channel and the inner cavity. Thus, the temperature of the charge fluid adapts to the temperature of the fluid flowing in the flow channel, via the flexible wall. As a consequence, the pressure inside the inner cavity is completely determined by the temperature of the fluid flowing in the flow channel.

Since the flexible wall defines an interface between the inner cavity and the flow channel, it is influenced by the pressure inside the inner cavity as well as by the pressure in the flow channel. Accordingly, the flexible wall will move or flex in response to the differential pressure between the pressure inside the inner cavity and the pressure in the flow channel. Since the pressure inside the inner cavity is determined by the temperature of the fluid flowing in the flow channel as described above, the position of the flexible wall is determined by a combination of the pressure and the temperature of the fluid flowing in the flow channel. Thus, the position of the flexible wall is an indication of the superheat of the fluid flowing in the flow channel.

The first wall part and the second wall part are arranged at a variable distance from each other. The distance is defined by a differential pressure between the pressure of the charge fluid, i.e. the pressure inside the inner cavity, and the pressure of the fluid, i.e. the pressure in the flow channel. As described above, this differential pressure is determined by a combination of the temperature and the pressure of the fluid flowing in the flow channel. Accordingly, the distance between the first wall part and the second wall part is an indication of the superheat of the fluid flowing in the flow channel. Preferably, the first wall part and/or the second wall part is/are connected to the flexible wall in such a manner that movements of the flexible wall results in variations in the distance between the first wall part and the second wall part. This will be described in further detail below.

The superheat sensor further comprises a distance sensor for measuring the distance between the first wall part and the second wall part, and means for calculating the superheat of the fluid flowing in the flow channel, based on the measured distance. As described above, the distance between the first wall part and the second wall part is an indication of the superheat of the fluid flowing in the flow channel, and therefore the superheat can be calculated from a measured value of this distance.

It is an advantage that the superheat is determined on the basis of a single measurement, since only one sensor is thereby required in order to determine the superheat, and thereby the number of required components is reduced as compared to sensor devices in which the temperature and the pressure of the fluid are measured independently by means of separate sensors. Furthermore, the superheat sensor of the invention is mechanically simple.

It is also an advantage that the temperature of the charge fluid is adapted to the temperature of the fluid flowing in the flow channel directly via the flexible wall, since a very efficient heat transfer is thereby obtained, in particular when the flexible wall covers a substantial part of the area enclosing the inner cavity. Furthermore, this arrangement is mechanically simple and allows the measurement of the temperature and the measurement of the pressure to be performed by the same device.

The charge fluid may have thermostatic properties which are similar to the thermostatic properties of the fluid flowing in the flow channel. The charge fluid may even be substantially identical to the fluid flowing in the flow channel. According to this embodiment the relation between pressure and temperature of the charge fluid is substantially identical to the relation between pressure and temperature of the fluid flowing in the flow channel. Thereby the relation between the distance between the wall parts, on the one hand, and the superheat of the fluid flowing in the flow channel, on the other hand, is relatively simple, and the calculation of the superheat from the measured distance can therefore easily be performed. However, the charge fluid may, alternatively, be any other suitable kind of fluid, even atmospheric air, as long as the relation between temperature and pressure is well known and well defined.

According to one embodiment, the flexible wall may be a diaphragm. In this case the diaphragm may form one wall of the inner cavity, and the inner cavity may further be enclosed by one or more substantially fixed walls.

The first wall part or the second wall part may form part of the diaphragm. In the case that the first wall part forms part of the diaphragm, the second wall part is preferably arranged in a substantially immovable manner. Thereby movements of the diaphragm in response to changes in the differential pressure results in movements of the first wall part. Since the second wall part is arranged in a substantially immovable manner, the first wall part is moved relative to the second wall part, and thereby the distance between the first wall part and the second wall part is varied.

Similarly, the second wall part may form part of the diaphragm, and the first wall part may be arranged in a substantially immovable manner.

Alternatively, the flexible wall may be a bellow. The bellow is preferably substantially enclosing the inner cavity, i.e. the interior of the bellow preferably forms the inner cavity. According to this embodiment, the first wall part and the second wall part may advantageously be or form part of end walls of the bellow. The bellow will expand or contract in response to changes in the differential pressure between the pressure inside the inner cavity and the pressure in the flow channel. Accordingly, the distance between the end walls of the bellow is varied.

The distance sensor may comprise a first sensor part arranged on the first wall part and a second sensor part arranged on the second wall part. In this case the first sensor part may be or comprise a permanent magnet, and the second sensor part may be or comprise a Hall sensor. According to this embodiment, the magnetic field originating from the permanent magnet and detected by the Hall sensor depends on the distance between the permanent magnet and the Hall sensor, and thereby on the distance between the first wall part and the second wall part. Accordingly, the measurements performed by the Hall sensor represent the distance between the wall parts, thereby providing a measure for the superheat of the fluid flowing in the flow channel. As an alternative, the first sensor part and the second sensor part may be any other suitable kinds of sensor parts being capable of detecting the distance between the wall parts. As an alternative, induction sensors, ultrasound sensors, capacitive sensors, sensors performing measurements using light, or any other suitable kind of sensor may be used for measuring the distance between the wall parts.

The sensor may further comprise mechanical biasing means arranged to mechanically bias the first wall part and the second wall part in a direction away from each other. The mechanical biasing means may be or comprise a compressible spring, e.g. arranged to push or pull the wall parts away from each other. The compressible spring may, e.g., be arranged inside the inner cavity in such a manner that it pushes the first wall part and/or the second wall part away from the second/first wall part. Alternatively, a compressible spring may be arranged outside the inner cavity, connected to the first wall part or the second wall part in such a manner that this wall part is pulled away from the other wall part. As another alternative, other mechanical biasing means, such as a component made from a deformable material, may be used.

The sensor may further comprise a temperature sensor arranged to measure the temperature of the fluid flowing in the flow channel. By measuring the temperature directly, it may be possible to determine the superheat of the fluid flowing in the flow channel in a more accurate manner. Furthermore, the pressure of the fluid flowing in the flow channel may be estimated from the measured temperature and the calculated superheat. The measured pressure may be used for controlling a refrigeration system in an even more optimal manner.

The fluid flowing in the flow channel may advantageously be a refrigerant, such as a refrigerant selected from one of the following groups of refrigerants: HFC, HCFC, CFC or HC. Another suitable refrigerant is $CO_2$. In this case the flow channel preferably forms part of a refrigerant path of a refrigeration system.

The means for calculating the superheat may further be adapted to generate a control signal based on the calculated superheat and to supply said control signal to a control unit for controlling operation of an expansion valve. According to this embodiment the sensor can advantageously be used when controlling a refrigeration system on the basis of the superheat value of the refrigerant.

BRIEF DESCRIPTION OF THE DRAWINGS

The invention will now be described in further detail with reference to the accompanying drawings in which.

DETAILED DESCRIPTION OF THE PREFERRED EMBODIMENTS

Figure 1:
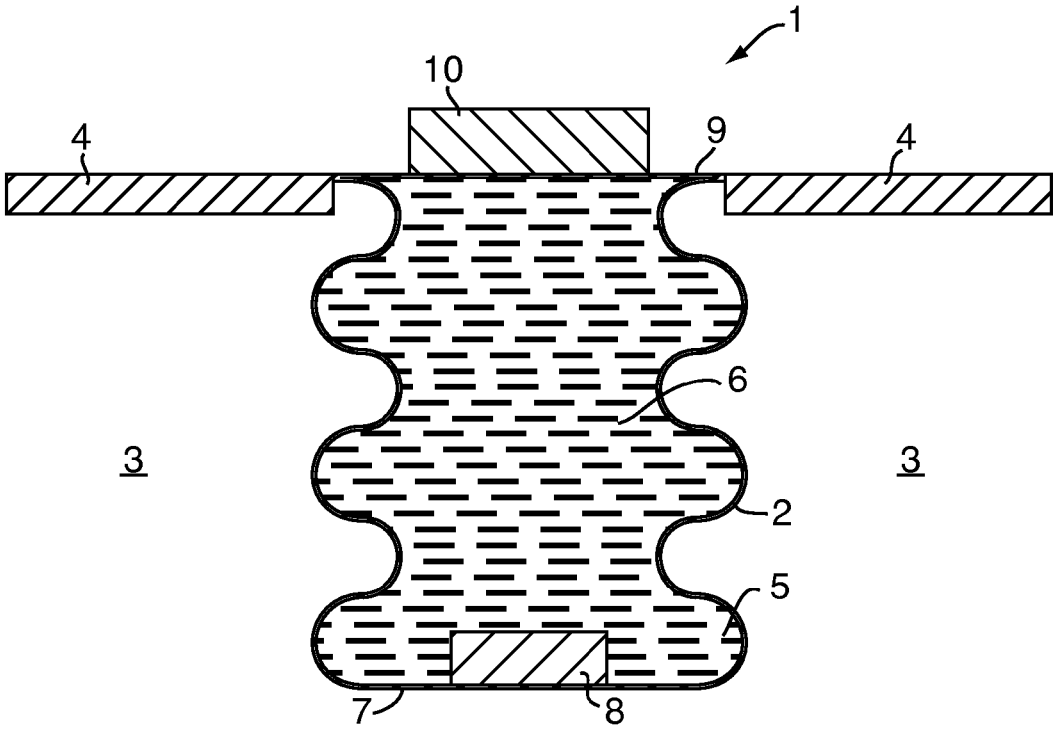
FIG. 1 is a cross sectional view of a superheat sensor according to a first embodiment of the invention, the superheat sensor comprising a bellow.

FIG. 1 is a cross sectional view of a superheat sensor 1 according to a first embodiment of the invention. A bellow 2 is arranged in a flow channel 3 which is partly limited by a stainless steel disk 4.

The bellow 2 encloses an inner cavity 5 which is filled with a charge fluid 6 having thermostatic properties which are similar to the thermostatic properties of the fluid flowing in the flow channel 3. A first end wall 7 of the bellow 2 has a permanent magnet 8 mounted thereon. A second end wall 9 of the bellow 2 has a Hall sensor 10 mounted thereon.

The superheat sensor 1 of FIG. 1 preferably operates in the following manner. As fluid flows in the flow channel 3 the temperature of the charge fluid 6 adapts to the temperature of the fluid flowing in the flow channel 3. Since the inner cavity 5 is closed, the temperature of the charge fluid 6, which is identical to the temperature of the fluid flowing in the flow channel 3, determines the pressure inside the inner cavity 5. Thus, if the temperature increases, the pressure in the inner cavity 5 increases, and the bellow 2 expands. However, if the pressure of the fluid flowing in the flow channel 3 increases it will cause the bellow 2 to contract. Accordingly, the bellow 2 will find a balanced position corresponding to the differential pressure between the pressure inside the inner cavity 5 and the pressure in the flow channel 3. Thus, the position of the bellow 2 is determined by the pressure of the fluid flowing in the flow channel 3 as well as the temperature of this fluid. Since the thermostatic properties of the charge fluid 6 are similar to the thermostatic properties of the fluid flowing in the flow channel 3, the calculation of the superheat of the fluid flowing in the flow channel 3 on the basis of the distance between the end walls 7, 9 is relatively simple. It should be noted that the charge fluid 6 may advantageously be identical to the fluid flowing in the flow channel 3.

As the bellow 2 expands or contracts, the first end wall 7 of the bellow 2 moves away from or towards the second end wall 9 of the bellow. As a consequence, the distance between the permanent magnet 8 and the Hall sensor 10 increases or decreases, and therefore the signal measured by the Hall sensor 10 varies as a function of the distance between the end walls 7, 9, and thereby as a function of the superheat of the fluid flowing in the flow channel 3.

Figure 2:
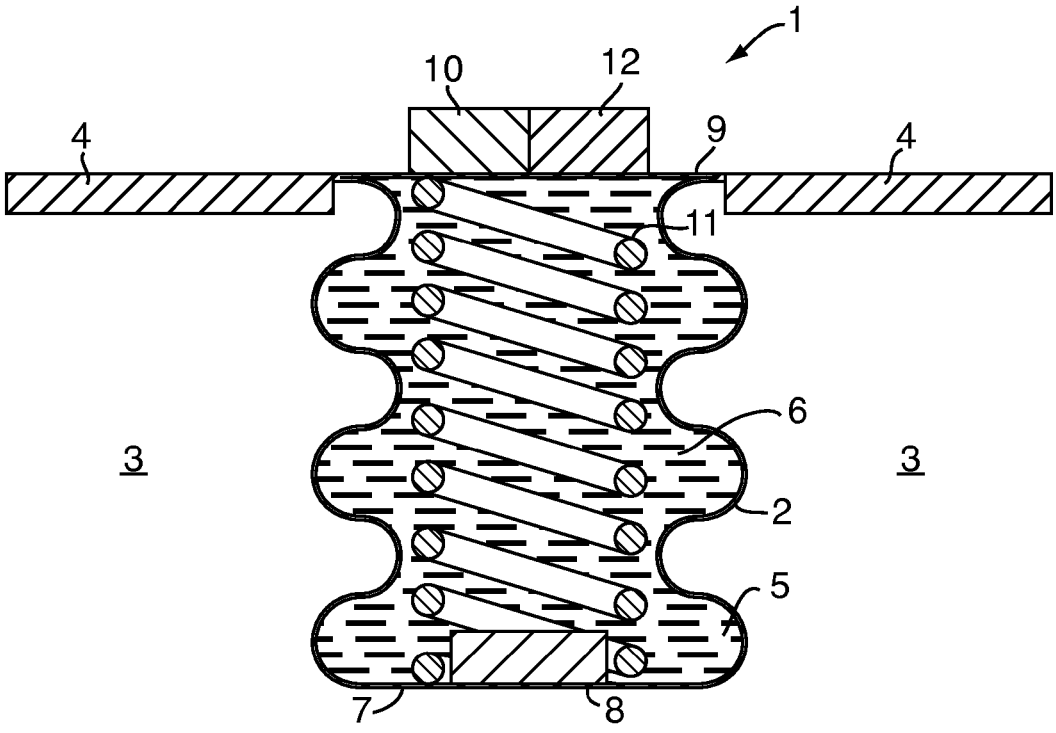
FIG. 2 is a cross sectional view of a superheat sensor according to a second embodiment of the invention, the superheat sensor comprising a bellow and a spring.

FIG. 2 is a superheat sensor 1 according to a second embodiment of the invention. The sensor 1 of FIG. 2 is very similar to the sensor 1 of FIG. 1, and it will therefore not be described in detail here. The sensor 1 of FIG. 2 comprises a compressible spring 11 arranged inside the inner cavity 5 in such a manner that it biases the first end wall 7 in a direction away from the second end wall 9. The sensor 1 is further provided with a temperature sensor 12 arranged to measure the temperature of the fluid flowing in the flow channel 3.

The embodiment shown in FIG. 2 can be operated without a charge fluid as described above with reference to FIG. 1 arranged in the inner cavity 5. In this case the position of the bellow 2 is determined solely by the pressure of the fluid flowing in the flow channel 3 and the spring constant of the compressible spring 11, i.e. the signal measured by the Hall sensor 10 represents the pressure of the fluid flowing in the flow channel 3 rather than the superheat of the fluid. However, the temperature sensor 12 provides the necessary measurement of the temperature of the fluid, thereby allowing the superheat to be calculated. Alternatively, a charge fluid as described above may be applied to the inner cavity 5, thereby allowing the superheat to be directly detected by the Hall sensor 10.

Figure 3:
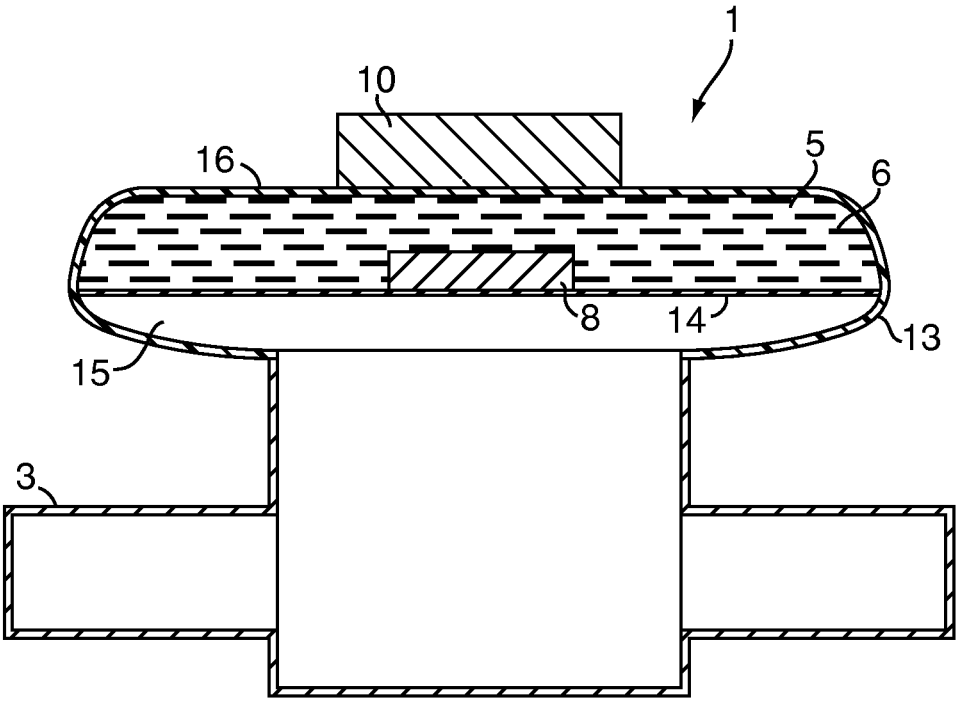
FIG. 3 is a cross sectional view of a superheat sensor according to a third embodiment of the invention, the superheat sensor comprising a diaphragm.

FIG. 3 is a cross sectional view of a superheat sensor 1 according to a third embodiment of the invention. In FIG. 3 a housing 13 is arranged in fluid contact with the flow channel 3. Inside the housing 13 a diaphragm 14 divides the interior of the housing 13 into an inner cavity 5 with a charge fluid 6 arranged therein and a part 15 which is directly fluidly connected to the flow channel 3. The charge fluid 6 has thermostatic properties which are similar to the thermostatic properties of the fluid flowing in the flow channel 3. The charge fluid 6 may even be identical to the fluid flowing in the flow channel 3. The diaphragm 14 is adapted to conduct heat.

A permanent magnet 8 is mounted on the diaphragm 14 and a Hall sensor 10 is mounted on a wall 16 of the housing 13, the wall 16 being arranged opposite the diaphragm 14.

The sensor 1 of FIG. 3 is preferably operated in the following manner. As fluid flows in the flow channel 3, the temperature of the charge fluid 6 adapts to the temperature of the fluid flowing in the flow channel 3 via the diaphragm 14. Similarly to the situation described above with reference to FIG. 1, the pressure inside the inner cavity 5 is completely determined by the temperature. This pressure operates on the side of the diaphragm 14 which faces the inner cavity 5. Simultaneously, the pressure in the part 15 of the housing 13 which is fluidly connected to the flow channel 3 is identical to the pressure in the flow channel 3. This pressure operates on the side of the diaphragm 14 which faces the part 15 of the housing 13 being fluidly connected to the flow channel 3. As a consequence, the diaphragm 14 moves in response to the differential pressure between the pressure inside the inner cavity 5 and the pressure in the flow channel 3, and the position of the diaphragm 14 is therefore representative for the superheat of the fluid flowing in the flow channel 3, similarly to the situation described above. The position of the diaphragm 14 is measured by measuring the distance between the permanent magnet 8 and the Hall sensor 10 in the same manner as described above with reference to FIG. 1.

The three superheat sensors 1 shown in FIGS. 1-3 are all mechanically simple sensors 1 capable of providing a measurement of the superheat of a fluid by measuring only a single parameter.

While the present invention has been illustrated and described with respect to a particular embodiment thereof, it should be appreciated by those of ordinary skill in the art that various modifications to this invention may be made without departing from the spirit and scope of the present.

What is claimed is:

1. A superheat sensor for sensing superheat of a fluid flowing in a flow channel, the sensor comprising:

a diaphragm dividing an interior of a housing into an inner cavity with a charge fluid arranged therein and a part of the housing being directly fluidly connected to the fluid flowing in the flow channel, the diaphragm being adapted to conduct heat between the fluid in the flow channel and the charge fluid in the inner cavity, a first wall part of the diaphragm and a second wall part of the housing being arranged opposite each other at a variable distance from each other, said distance being defined by a differential pressure between the pressure of the charge fluid and the pressure of the fluid flowing in the flow channel, a distance sensor for measuring the distance between the first wall part of the diaphragm and the second wall part of the housing, the distance sensor comprising a first sensor part arranged on the first wall part of the diaphragm and a second sensor part arranged on the second wall part of the housing, and means for calculating the superheat of the fluid flowing in the flow channel, based on the measured distance.

2. The sensor according to claim 1, wherein the charge fluid has thermostatic properties which are similar to the thermostatic properties of the fluid flowing in the flow channel.

3. The sensor according to claim 2, wherein the charge fluid is substantially identical to the fluid flowing in the flow channel.

4. The sensor according to claim 1, wherein the first sensor part is or comprises a permanent magnet, and the second sensor part is or comprises a Hall sensor.

5. The sensor according to claim 1, further comprising mechanical biasing means arranged to mechanically bias the first wall part and the second wall part in a direction away from each other.

6. The sensor according to claim 5, wherein the mechanical biasing means is or comprises a compressible spring.

7. The sensor according to claim 1, further comprising a temperature sensor arranged to measure the temperature of the fluid flowing in the flow channel.

8. The sensor according to claim 1, wherein the fluid flowing in the flow channel is a refrigerant.

9. The sensor according to claim 1, wherein the means for calculating the superheat is further adapted to generate a control signal based on the calculated superheat and provide said control signal.

10. A superheat sensor for sensing superheat of a fluid flowing in a flow channel, the sensor comprising:

a bellow defining an interface between an inner cavity filled with a charge fluid and the flow channel, the bellow being arranged in the flow channel in thermal contact with the fluid flowing therein, and the bellow being adapted to conduct heat between the flow channel and the inner cavity, a first wall part at one end of the bellow and a second wall part at another end of the bellow being arranged at a variable distance from each other, said distance being defined by a differential pressure between the pressure of the charge fluid and the pressure of the fluid flowing in the flow channel, a distance sensor for measuring the distance between the first wall part at one end of the bellow and the second wall part at another end of the bellow, the distance sensor comprising a first sensor part arranged on the first wall part at one end of the bellow and a second sensor part arranged on the second wall part at another end of the bellow, and means for calculating the superheat of the fluid flowing in the flow channel, based on the measured distance.

* * * * *